US006999707B2

(12) United States Patent
Okamura

(10) Patent No.: US 6,999,707 B2
(45) Date of Patent: Feb. 14, 2006

(54) METHOD OF FORMING IMAGE AND IMAGE FORMING APPARATUS

(75) Inventor: Takehiko Okamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 10/756,751

(22) Filed: Jan. 14, 2004

(65) Prior Publication Data

US 2004/0234300 A1 Nov. 25, 2004

(30) Foreign Application Priority Data

Jan. 14, 2003 (JP) ..... P. 2003-005721

(51) Int. Cl.
*G03G 15/06* (2006.01)
*G03G 15/08* (2006.01)

(52) U.S. Cl. ..... 399/285; 399/55

(58) Field of Classification Search ..... 399/55, 399/56, 266, 270, 285
See application file for complete search history.

(56) References Cited

U.S. PATENT DOCUMENTS 6,101,357 A * 8/2000 Wayman ..... 399/266

FOREIGN PATENT DOCUMENTS

JP 58-32377 B2 7/1983
JP 4-56976 A 2/1992

* cited by examiner

*Primary Examiner*—Hoang Ngo
(74) *Attorney, Agent, or Firm*—Sughrue Mion, PLLC

(57) ABSTRACT

A method of forming an image includes the steps of providing a development bias having a DC component and an AC component superposed on one another and applying the development bias to a developer carrying member. The AC component is provided by superposing a waveform at a second frequency on a waveform at a first frequency in synchronism with each other. The second frequency is an odd multiple of the first frequency.

8 Claims, 5 Drawing Sheets

METHOD OF FORMING IMAGE AND IMAGE FORMING APPARATUS

BACKGROUND OF THE INVENTION

The present invention relates to a method and an apparatus for forming an electrophotographic image for printers, copying machines, and facsimile apparatus in which toner is deposited on an electrostatic latent image formed on an image carrying member to develop the image.

Methods of developing an electrostatic latent image on an image carrying member by applying a development bias having a DC component and an AC component superposed on one another to a developer carrying member is well known by, for example, JP-A-58-32377 and JP-A4-56976.

FIG. 1 is a diagram for explaining a method of applying a development bias of the related art, and it shows a waveform of a development bias in a case wherein an image carrying member is charged at −600 V and development is performed using a negatively charged toner with the image portion charged at a potential of −70 V. One period of the development bias has a time t1 on a development restraining side of the period during which the toner deposited on the image carrying member is separated and peeled off from the member toward a developer carrying member and a time t2 on a development promoting side of the period during which the toner is transferred from the developer carrying member to the image carrying member. According to the related method, the toner is repeatedly deposited on and separated from the image carrying member due to an oscillating electric field formed at the portion to be developed, and the toner is finally deposited on the electrostatic latent image and remains thereon to complete development as a result of attenuation of the oscillating electric field attributable to an increase in the interval between the image carrying member and the developer carrying member.

FIG. 2 shows γ-characteristics of gradation in a case wherein the development bias in FIG. 1 is set at frequencies of 1 kHz and 3 kHz, an amplitude Vpp of 1600 V, and a DC component average potential Vavg of −200 V. FIG. 3 shows γ-characteristics of a contrast potential (an image portion potential Vs−Vavg) at a duty ratio ACDuty of 40%. FIGS. 4 and 5 show contrast potential γ-characteristics and gradation γ-characteristics, respectively, at a frequency of 3 kHz and duty ratios ACDuty of 40%, 60%, and 80%. A duty ratio ACDuty is defined as $t1/(t1+t2)\times 100(\%)$.

As shown in FIG. 2, at a frequency as high as 3 kHz, the gradation γ-characteristics are in the form of the character S rather than being linear, which results in a low density in a highlight and missing gradations in a shadow. At a frequency as low as 1 kHz, the gradation γ-characteristics are linear, and preferable gradation is exhibited in that a highlight has a high density and no gradation is lost in a shadow. However, a problem arises as shown in FIG. 3 in that there are many fogs on the background at a non-image potential at the low frequency of 1 kHz although there are less fogs on the background at the rion-mage potential at the high frequency of 3 kHz.

In JP-A-56976, a solution to this problem is sought through appropriate selection of a ratio between the product of voltage and time on the development promoting side and the product of voltage and time on the restraining side. However, when the duty ratio is varied for a single frequency, the linearity of gradation γ-characteristics cannot be improved as shown in FIG. 5, although there is no increase in fogs on the background as shown in FIG. 4. Thus, there is a problem in that it is difficult to increase the density of a highlight.

That is, it has been difficult to achieve both of (1) gradation γ-characteristics with high reproducibility of a highlight and high linearity and (2) formation of an image without deposition of toner on a non-image portion by simply changing the frequency or duty ratio.

SUMMARY OF THE INVENTION

The invention solves the above-described problems in the related art, and it is an object of the invention to provide a method and apparatus for forming an image in which the linearity of gradation γ-characteristics can be improved to allow highlights to be reproduced with high densities and to allow shadows to be reproduced without missing gradations and in which an image can be formed with less fogs on the background.

In order to achieve the above object, according to the present invention, there is provided a method of forming an image comprising the steps of:

providing a development bias having a DC component and an AC component superposed on one another; and applying the development bias to a developer carrying member, wherein the AC component is provided by superposing a waveform at a second frequency on a waveform at a first frequency in synchronism with each other, and wherein the second frequency is an odd multiple of the first frequency.

According to the present invention, there is also provided an image forming apparatus comprising:

developer carrying member, to which a development bias is applied, wherein the development bias having a DC component and an AC component superposed on one another;

wherein the AC component is provided by superposing a waveform at a second frequency on a waveform at a first frequency in synchronism with each other; and wherein the second frequency is an odd multiple of the first frequency.

Preferably, a potential for forming an electric field in a separating direction of a developer is maintained relative to a potential at an image carrying member in a half period of a developing side on one period of the first frequency.

Preferably, a potential for forming an electric field in a developing direction is maintained relative to a potential at the image carrying member in a half period of a developing side on one period of the first frequency.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
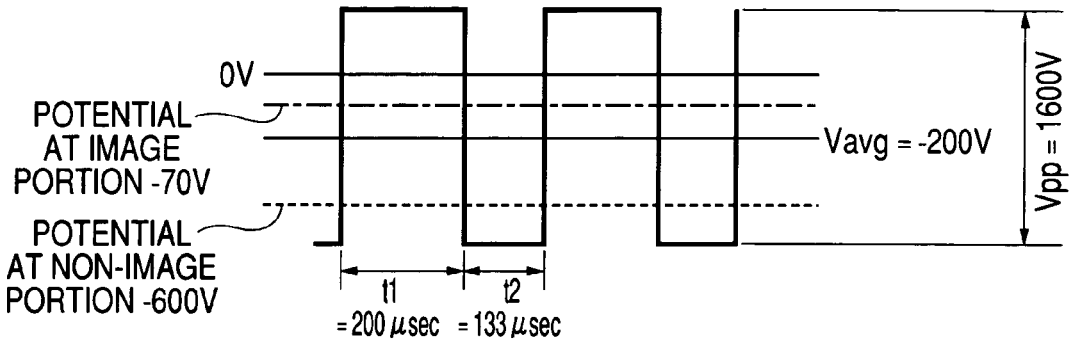
FIG. 1 is a diagram for explaining a method of applying a development bias according to the related art.
Figure 2:
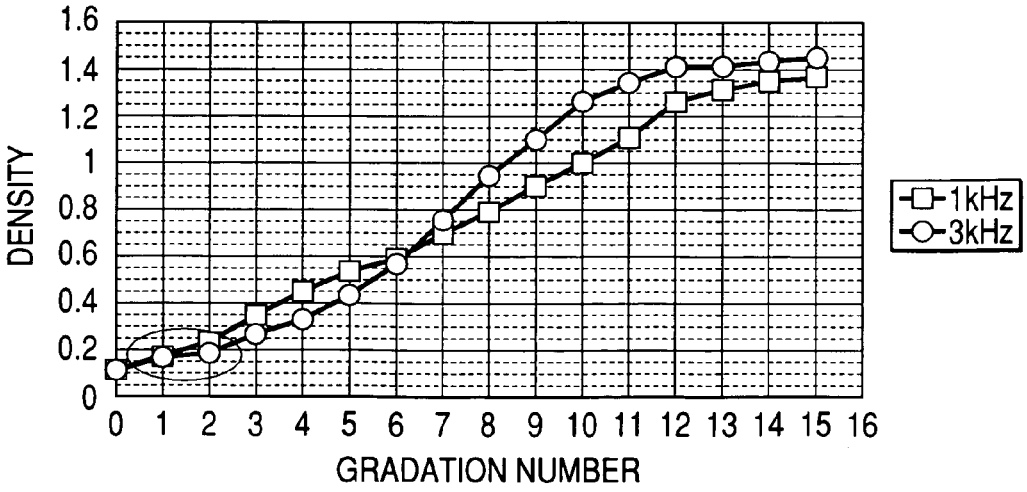
FIG. 2 is a graph showing gradation γ-characteristics according to the method in the related art.
Figure 3:
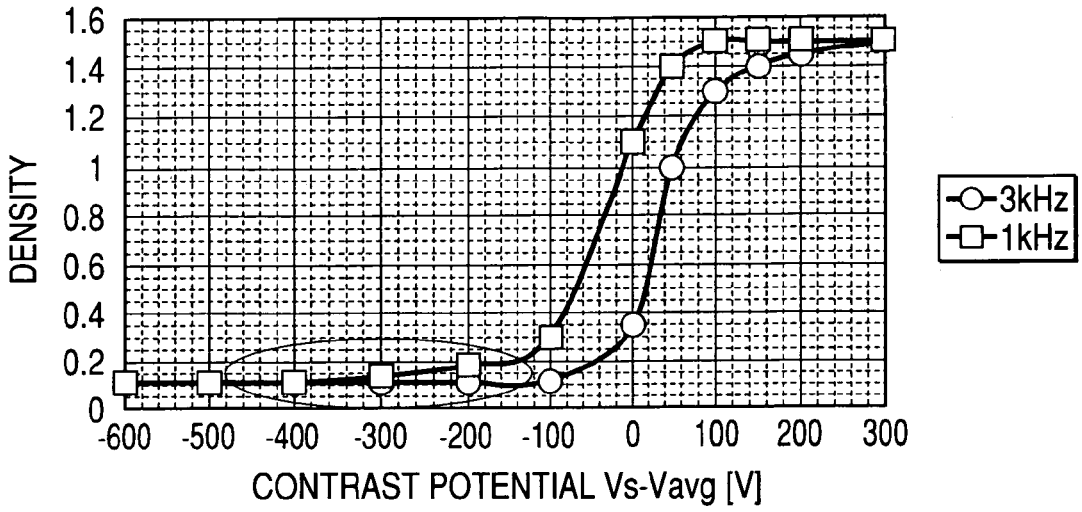
FIG. 3 is a graph showing contrast potential γ-characteristics according to the method in the related art.
Figure 4:
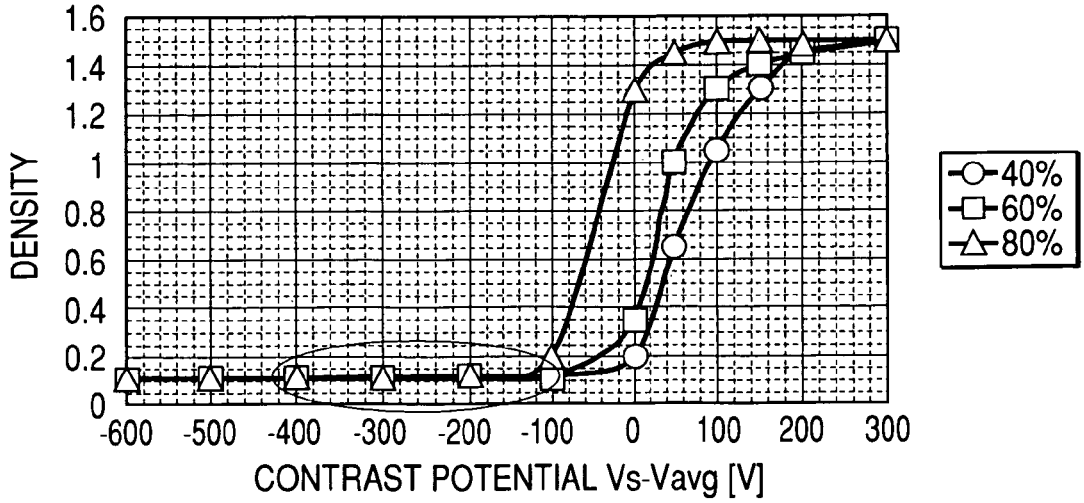
FIG. 4 is a graph showing contrast potential γ-characteristics according to another method in the related art.
Figure 5:
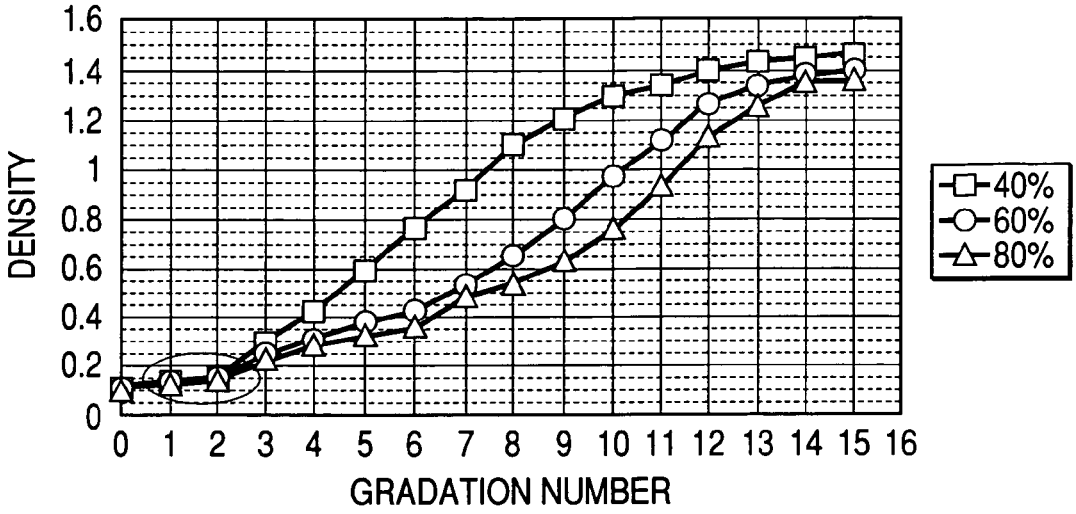
FIG. 5 is a graph showing gradation γ-characteristics according to the method in the related art.
Figure 6:
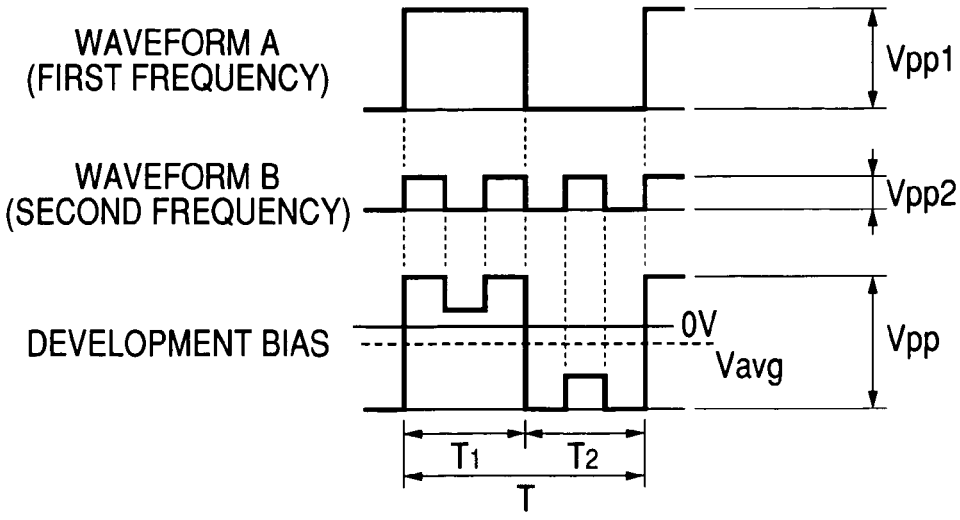
FIG. 6 is a diagram for explaining a development bias in a mode for carrying out the invention.

Embodiments for carrying out the invention will now be described with reference to the drawings. FIG. 6 is a diagram for explaining a development bias according to a first embodiment of the invention.

The development bias has an AC component and a DC component having an average potential Vavg superposed on one another, and the AC component is provided by superimposing a waveform B at a second frequency having an amplitude Vpp2 on a waveform A at a first frequency having an amplitude Vpp1 in synchronism with each other, the second frequency being an odd multiple (three times in the first embodiment and five times in the second embodiment) of the first frequency. That is, a low frequency and a high frequency are combined in the direction of the strength of an electric field (voltage) in order to make it possible to achieve both of gradation γ-characteristics with high reproducibility of a highlight and high linearity using the low frequency and formation of an image without deposition of toner on a non-image portion using the high frequency.

When such a development bias is applied, separation of toner from an image carrying member can be promoted to form an image with less fogs on the background by maintaining a potential for forming an electric field in the separating direction relative to a potential at the image carrying member in one half period T1 of one period T of the first frequency on a separating side of the same. Development of the toner on the image carrying member can be promoted to improve the reproducibility of a highlight by maintaining an electric field for forming an electric field in the developing direction relative to the potential at the image carrying member in another half period T2 of the first frequency on a developing side of the same.

First Embodiment

A development bias was set by superimposing a waveform A of a square wave having a frequency of 1 kHz and an amplitude Vpp1 of 1075 V and a waveform B of a square wave having a frequency of 3 kHz and an amplitude Vpp2 of 325 V on one another to provide an AC component of the development bias on which a DC component Vavg of 220 V was further superposed. The density of an image was measured with the AC component of the development bias set at the above-described conditions relative to a potential Vs of −70 V at the image portion of the photosensitive member and with the average potential Vavg of the DC component varied from −370 V to +530 V, and contrast potential γ-characteristics as shown in FIG. 7 were obtained.

Figure 7:
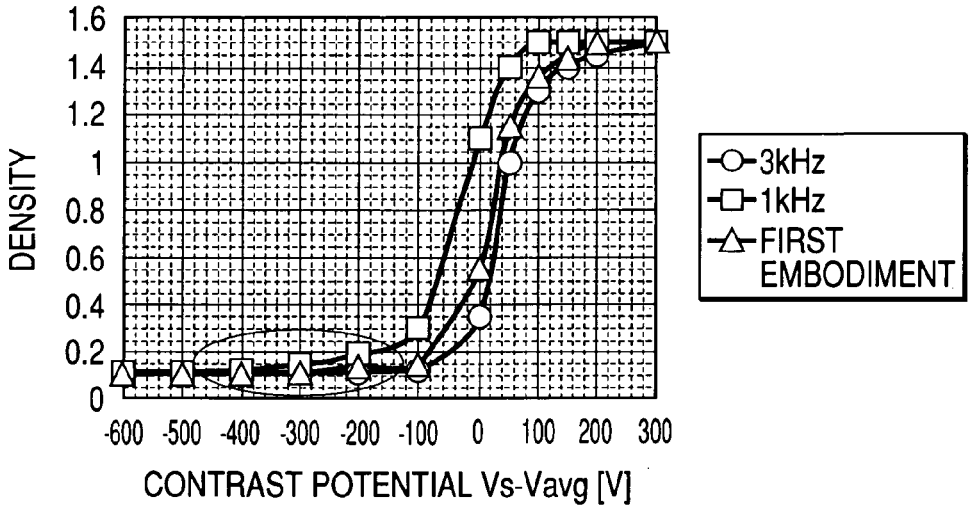
FIG. 7 is a graph showing contrast potential γ-characteristics according to a first embodiment of the invention.

As shown in FIG. 7, a sufficient image density of 1.45 is obtained at a contrast potential of 150 V, and characteristics are achieved that allow a sufficient image density to be obtained by setting the average potential Vavg of the DC component of the development bias at −220 V relative to the potential of −70 V at the image portion of the photosensitive member.

As shown in FIG. 7, fogs on the background of the image were sufficiently reduced by setting the potential Vs at the photosensitive member with a potential difference of −400 V from the average potential Vavg of the DC component of the development bias. Normally, a density of 0.11 constitutes a quality that is identified as a fog on the background just as in the case of paper, and there must be a potential difference of 200 V from the potential at which the density is saturated at 0.11 (normally, a density meter has no sensitivity in the region of the quality that is identified as a fog on the background). Therefore, an image without fogs on the background can be obtained by setting the potential at the non-image portion of the photosensitive member at −620 V relative to the average potential Vavg of −220 V of the DC component of the development bias.

Figure 8:
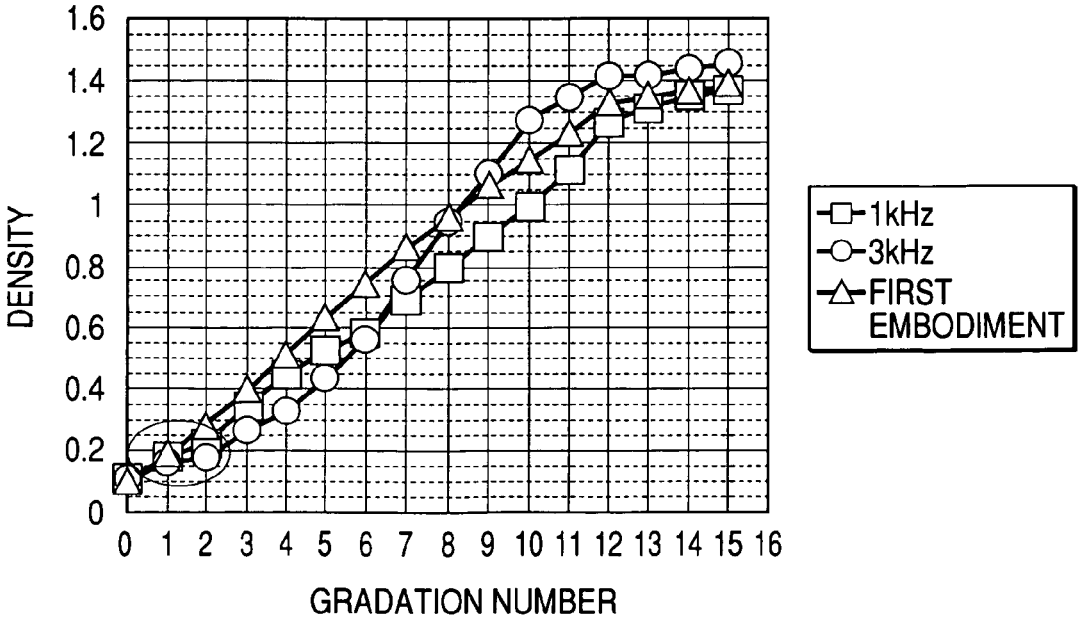
FIG. 8 is a graph showing gradation γ-characteristics in the first embodiment of the invention.
Figure 9:
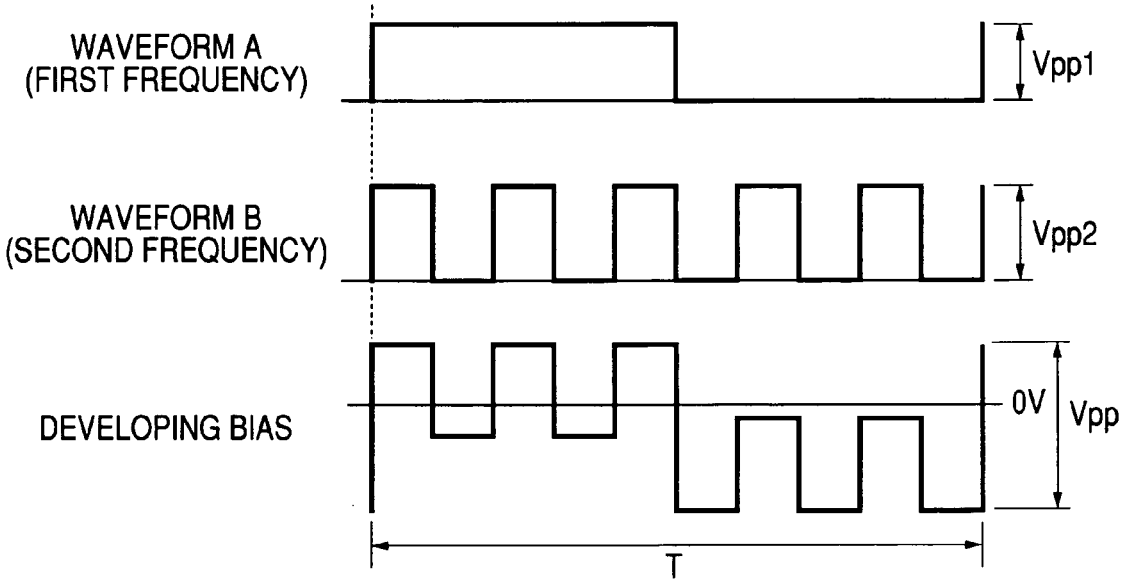
FIG. 9 is a diagram showing a development bias according to a second embodiment of the invention.

Further, the density of the image was measured using an areal gradation pattern having 16 steps by setting an exposure energy amount of 0.3 $\mu J/cm^2$ that allowed one dot line of 600 dpi to be reproduced without any discontinuation at the potentials of the image portion and non-image portion of the above-described photosensitive member, and gradation γ-characteristics as shown in FIG. 8 were obtained. In the first embodiment, the linearity of the gradation γ-characteristics was higher than that achieved at a frequency of 3 kHz and a duty ratio ACDuty of 60% according to the related art; sufficient reproducibility was achieved for gradation Nos. 1 and 2 which were highlights; and shadows could be reproduced up to gradation No. 14.

Second Embodiment

A development bias was set by superposing a waveform A of a square wave having a frequency of 1 kHz and an amplitude Vpp1 of 600 V and a waveform B of a square wave having a frequency of 5 kHz and an amplitude Vpp2 of 800 V on one another to provide an AC component of the development bias on which a DC component Vavg of 220 V was further superposed. A sufficient image density of 1.45 was obtained at a contrast potential of 180 V. Specifically, a sufficient image density was obtained by setting the average potential Vavg of the DC component of the development bias at −250 V relative to a potential of −70 V at the image portion of the photosensitive member. Fogs on the background of the image were sufficiently reduced by setting the potential Vs at the photosensitive member with a potential difference of −320 V from the average potential Vavg of the DC component of the development bias. Therefore, an image without fogs on the background can be obtained by setting the potential at the non-image portion of the photosensitive member at −570 V relative to the average potential Vavg of −250 V of the DC component of the development bias.

Further, the density of the image was measured using an areal gradation pattern having 16 steps by setting an exposure energy amount of 0.3 $\mu J/cm^2$ that allowed one dot line of 600 dpi to be reproduced without any discontinuation at the potentials of the image portion and non-image portion of the above-described photosensitive member. As a result, sufficient reproducibility was achieved for gradation Nos. 1 and 2 which were highlights; and shadows could be reproduced up to gradation No. 14.

A thus described, the waveforms in the second embodiment made it possible to form an image in which the linearity of gradation γ-characteristics was improved to allow highlights to be reproduced with high densities and to allow shadows to be reproduced without missing gradations at the same time and in which fogs on the background could be reduced using a potential difference, which was smaller than that in the first embodiment, between the average potential Vavg of the development bias DC component and the potential at the non-image portion of the photosensitive member.

As apparent from the above description, the invention makes it possible to form an image in which the linearity of gradation γ-characteristics is improved to allow highlights to be reproduced with high densities and to allow shadows to be reproduced without missing gradations at the same time and which has less fogs on the background.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A method of forming an image comprising the steps of:

providing a development bias having a DC component and an AC component superposed on one another; and applying the development bias to a developer carrying member, wherein the AC component is provided by superposing a waveform at a second frequency on a waveform at a first frequency in synchronism with each other; and wherein the second frequency is an odd multiple of the first frequency.

2. The method as set forth in claim 1, wherein a potential for forming an electric field in a separating direction of a developer is maintained relative to a potential at an image carrying member in a half period of a developing side on one period of the first frequency.

3. The method as set forth in claim 1, wherein a potential for forming an electric field in a developing direction is maintained relative to a potential at the image carrying member in a half period of a developing side on one period of the first frequency.

4. An image forming apparatus comprising:

developer carrying member, to which a development bias is applied, wherein the development bias having a DC component and an AC component superposed on one another;

wherein the AC component is provided by superposing a waveform at a second frequency on a waveform at a first frequency in synchronism with each other; and wherein the second frequency is an odd multiple of the first frequency.

5. The image forming apparatus as set forth in claim 4, wherein a potential for forming an electric field in a separating direction of a developer is maintained relative to a potential at an image carrying member in a half period of a developing side on one period of the first frequency.

6. The image forming apparatus as set forth in claim 4, wherein a potential for forming an electric field in a developing direction is maintained relative to a potential at the image carrying member in a half period of a developing side on one period of the first frequency.

7. The method as set forth in claim 1, wherein the development bias applied to the developer carrying member controls a separation of a developer from the image carrying member and controls a development of the developer on the image carrying member.

8. The image forming apparatus as set forth in claim 4, wherein the development bias applied to the developer carrying member controls a separation of a developer from the image carrying member and controls a development of the developer on the image carrying member.

* * * * *